US007775956B2

(12) United States Patent
Wolff et al.

(10) Patent No.: US 7,775,956 B2
(45) Date of Patent: Aug. 17, 2010

(54) PROCESS AND APPARATUS FOR PROCESSING FILTER TOW STRIP

(75) Inventors: Stephen Wolff, Glinde (DE); Gerd Strohecker, Marschacht (DE); Sönke Horn, Geesthacht (DE); Jan Peisker, Schulendorf (DE)

(73) Assignee: Hauni Maschinenbau AG, Hamburg (DE)

( * ) Notice: Subject to any disclaimer, the term of this patent is extended or adjusted under 35 U.S.C. 154(b) by 549 days.

(21) Appl. No.: 11/785,577

(22) Filed: Apr. 18, 2007

(65) Prior Publication Data

US 2008/0251090 A1 Oct. 16, 2008

(30) Foreign Application Priority Data

Apr. 18, 2006 (DE) ..... 10 2006 018 101

(51) Int. Cl.
*B31C 99/00* (2009.01)
*A24C 5/18* (2006.01)

(52) U.S. Cl. ..... 493/49; 493/42; 493/44; 131/88; 131/84.1

(58) Field of Classification Search ..... 493/42, 493/44, 45, 46, 49; 131/88, 84.1
See application file for complete search history.

(56) References Cited

U.S. PATENT DOCUMENTS 3,329,543 A * 7/1967 Arthur et al. ..... 156/152
3,566,753 A * 3/1971 Mantke ..... 493/47
5,590,449 A * 1/1997 Chehab et al. ..... 28/240
6,263,882 B1 * 7/2001 Chehab et al. ..... 131/84.1

FOREIGN PATENT DOCUMENTS

| | | | |
|---|---|---|---|
| EP | 1 314 363 | A | 5/2003 |
| EP | 1 625 799 | A | 2/2006 |
| EP | 1 673 990 | A | 6/2006 |
| EP | 1 726 223 | A | 11/2006 |
| GB | 2 020 158 | A | 11/1979 |
| GB | 2265298 | * | 9/1993 |
| WO | WO-2005/058079 | A1 | 6/2005 |

OTHER PUBLICATIONS

European Search Report, dated Aug. 10, 2007, issued for counterpart European Application No. 07007595.7-2313 (w/English-language Translation).
Chinese Search Report dated Jan. 15, 2010, issued in counterpart Chinese Patent Application No. 2007100961884, along with it's English-language translation.
European Office Action dated Dec. 4, 2009, issued in counterpart European Patent Application No. 07 007 595.7-2313, and an English-language translation.

* cited by examiner

*Primary Examiner*—Hemant M Desai
(74) *Attorney, Agent, or Firm*—Venable LLP; Robert Kinberg; Leigh D. Thelen

(57) ABSTRACT

A processing unit for processing at least one filter tow strip to produce filters for rod-shaped smoking articles includes at least one tow guidance section along which the filter tow strip is moved in a direction of a longitudinal extension of the filter tow strip. The tow guidance section includes processing devices used for processing the filter tow strip. The processing devices are arranged in a sequence essentially one above the other, so that at least a segment of the tow guidance section that is located in a region of the processing devices is oriented at an angle to a horizontal line.

35 Claims, 12 Drawing Sheets

PROCESS AND APPARATUS FOR PROCESSING FILTER TOW STRIP

CROSS-REFERENCE TO RELATED APPLICATION

This application claims the priority of German Patent Application No: 10 2006 018 101.8, filed on Apr. 18, 2006, the subject matter of which is incorporated herein by reference, together with each U.S. and foreign patent and patent application mentioned below.

BACKGROUND

The present invention relates to a processing unit for processing at least one filter-tow strip for producing filters for rod-shaped smoking articles such as cigarettes, such a unit comprising at least one tow guidance section along which the filter-tow strip can move in the direction of its longitudinal extension, as well as multiple processing devices that are assigned to the tow guidance section for processing the filter tow strip. The invention furthermore relates to an apparatus for processing filter tow material for the production of filters for rod-shaped smoking articles such as cigarettes, with a filter tow supply for supplying at least two filter tow strips to at least two processing units. The invention also relates to a system comprising at least one such apparatus and at least one downstream-positioned apparatus for processing the filter tow strips.

A processing unit, an apparatus, and a system of this type are known, for example from German patent applications DE 42 09 789 A1 and DE 43 08 093 A1. The known apparatuses can be used for producing filter rods with the dual-rod forming method by pulling strips of filter tow (e.g. consisting of cellulose acetate fibers) from a bale, which are then processed by drawing and treating them with a plasticizer, reshaping them into a round form, and subsequently supplying them in the desired form and consistency to a continuous filter-rod forming machine for further processing. In this machine, a continuous filter rod is produced by wrapping the processed filter tow strip with a wrapping material. The finished, continuous filter rod is then cut into individual filter rod sections for producing cigarettes or other rod-shaped smoking articles.

Even though the above-described apparatuses and systems have proven themselves in practical operations, it has turned out that in some cases it is difficult to meet the space requirements for setting up an apparatus or system of this type. In addition, there is an increased need for higher flexibility during the manufacturing of these apparatuses and systems.

SUMMARY

In view of the above findings, it is an object of the present invention to further improve a processing unit and an apparatus of the aforementioned type.

The above and other objects are accomplished according to the invention by the provision a processing unit for processing at least one filter tow strip for producing filters for rod-shaped smoking articles such as cigarettes. According to an embodiment of the invention, the processing unit comprises at least one tow guidance section along which the filter tow strip is moved in a direction of a longitudinal extension of the filter tow strip, the tow guidance section including processing devices used for processing the filter tow strip, wherein the processing devices are arranged in a sequence essentially one above the other, so that at least a segment of the tow guidance section that is located in a region of the processing devices is oriented at an angle to a horizontal line.

Since the processing devices according to the invention are essentially arranged one above the other, the footprint for the processing unit can be reduced considerably. To be sure, for specific embodiments and contrary to the prior art, the inventive processing unit may still require a greater height in the vertical direction. However, in view of the advantage of a noticeable reduction in the space requirement in the horizontal direction achieved with the design according to the invention, this is acceptable and does not otherwise present a problem. Arranging the processing devices essentially one above the other results in an angled tow movement path, relative to the horizontal line, extending approximately vertical in one embodiment. In turn, this allows easier access to the processing devices and the tow guidance section, thereby resulting in a further advantage of easy maintenance and repair.

The term "tow guidance section" as used herein is understood to refer only to the path along which the filter tow strip moves through the processing unit. Of course, a movement guide can be provided for at least some segments of the tow guidance section, which supports the tow strip movement. However, a movement guide of this type is not absolutely necessary, at least not along the complete path. Especially in the case of an essentially vertical orientation of at least the segment of the tow guidance section that is located in the region of the processing devices, the filter tow strip in particular can also move freely between respectively two adjacent processing devices.

For the design according to the invention, it is useful to have a modular processing unit, which is provided with a defined interface for connecting it to at least one additional processing unit. A modular design is suitable to meet an increasing requirement for higher flexibility during manufacturing of a continuous filter rod-forming system. The combination of several modular processing units makes it particularly easy to realize a multi-rod forming machine, for which the footprint is determined by the number of processing units selected and thus depends on the number of continuous rods, but is still noticeably smaller as compared to traditional multi-rod forming machines. It is also conceivable in this connection to provide at least one of the processing units with two guide sections for the tow and thus embody it as a dual-rod forming module. The modular design furthermore results in a higher number of identical parts, meaning on the whole a lower structural expenditure, which in turn advantageously results in lower production and maintenance costs.

The processing unit may comprise an interface for linking it to a downstream-positioned apparatus for further processing of the filter tow strip, in particular to a continuous rod-forming machine.

Another embodiment of the invention is distinguished in that the processing devices are sequentially arranged so that at least along the tow guidance segment extending in the region of the processing devices, the filter tow strip is subjected to a downward movement. This design makes advantageous use of the effect of gravity, which supports at least partially the filter tow strip movement, at least along the tow guidance segment that is located in the region of the processing devices. This embodiment furthermore takes into consideration that the filter tow strip is primarily pulled in an upward direction from a bale that is arranged adjacent to the processing unit.

For an especially effective use of the gravity effect, the inlet which forms the start of the tow guidance section should not be positioned lower than the processing device in the highest position and may be arranged above this processing device, so that the effect of gravity permits a substantially automatic threading of the filter tow strip into the processing unit.

At least one filter tow feeding device is advantageously provided for feeding the filter tow strip from a filter tow supply to the inlet, wherein the filter tow supply contains at least one filter tow bale and is provided with an extension arm on its upper, exposed end, which is designed to redirect the filter tow strip that is to be pulled from the bale at a required height in the direction of the inlet where it enters the processing unit. The processing unit may additionally be provided with an outlet where the processed filter tow strip can exit in the direction of a downstream-positioned apparatus for the further processing. For this, the filter tow feeding mechanism may advantageously be embodied and arranged so that it guides the filter tow strip from the filter tow supply toward the inlet, approximately in the same direction as, or at an angle to (and preferably approximately transverse to), the direction in which the processed filter tow strip moves when it exits from the outlet. With this embodiment, the filter tow supply means can be positioned optionally behind or beside the processing unit.

For the above-described embodiment, a pair of threading rollers may be arranged downstream and adjacent to the inlet, if necessary, to effectively support the guidance of the filter tow strip that enters the processing unit under the effect of gravity and moves in the direction of the first processing device.

The tow guidance section can be oriented at least partially in an approximately horizontal direction between the last processing device and the outlet where the processed filter tow strip exits in the direction of the downstream-positioned apparatus for the further processing. In cases where the tow strip moves essentially in a vertical downward direction through the processing devices, the tow guidance section preferably can extend approximately horizontal, at least in part, between the lowest processing device and the outlet. It is furthermore conceivable to additionally or alternatively deflect the tow guidance section in a vertical direction after the last processing device, so as to adapt the discharge height for the processed filter tow strip to the inlet height of the downstream-positioned apparatus.

The processing devices may consist of devices for spreading out, drawing, treating and/or forming the filter tow strip.

A device for the round-forming of the filter tow strip may be provided, for example, which preferably is the last device in the series of processing devices. The resulting advantage is that following the exit from this last processing device, the filter tow strip that now has an essentially round cross section in principle can be deflected to any direction before it exits the processing unit.

A processing device may also be provided for treating the filter tow strip with a treatment fluid by spraying such fluid onto the filter tow strip. The device for spraying treatment fluid onto the filter tow strip may be embodied to extend horizontally, at an angle to or approximately transverse to the movement direction of the filter tow strip. As a result of the angled and preferably approximately vertical tow movement, relative to a horizontal line, any contact between the filter tow strip and the treatment device and particularly its spray box is easily prevented without increased costs for the guidance. Otherwise, this could result in damage to the filter tow strip as a result of undesirable adherence to the treatment device and could lead to operational interruptions. Spraying on the fluid at an angle or transverse, meaning horizontally, to the preferably vertical movement direction of the filter tow strip, has the further advantage that the filter tow strip is not affected even in cases where drops form. In that case, the drops float downward beside the filter tow strip and are collected, for example, in a basin intended for this. The possible forming of drops is therefore essentially non-critical, which is important especially in the case of an interruption in the operation and/or a machine stoppage.

Furthermore, the angled or preferably approximately vertical tow movement, relative to the horizontal line, optionally also allows spraying both sides of the filter tow strip with treatment fluid, thus resulting in a more effective treatment of the filter tow strip.

One of the treatment devices may furthermore be provided with a mechanism for injecting particle-type additives into and/or onto the filter tow strip, for example activated carbon powder or granulate. Of course, other functions not listed herein are also conceivable for the processing devices.

When using a modular design, or at least when using two processing units, each processing unit may be provided with at least one additional inlet and at least one additional outlet, wherein the filter tow strip processed by a different processing unit may be guided through the additional inlet and/or outlet. The filter tow strips processed by these processing units can thus move substantially in the same direction toward the same downstream-positioned apparatus.

It is furthermore also conceivable to provide at least two, preferably approximately parallel extending, tow guidance sections in one processing unit. In that case, it may be useful to assign at least some of the processing devices jointly to the tow guidance sections in one and the same processing unit. Of course, each tow guidance section can alternatively also be provided with separate processing devices.

According to a further aspect of the invention, there is provided an apparatus for processing filter tow material for producing filters for rod-shaped smoking articles such as cigarettes. In one embodiment, the apparatus comprises a filter tow supply for supplying at least two filter tow strips, and at least two processing units. An apparatus of this type consequently has a substantially modular design and comprises at least two processing units.

An apparatus of this type may also comprise a modular guidance device for guiding the filter tow strip that is processed in the processing units to a downstream-positioned apparatus for the further processing, for example a continuous rod-forming machine. For example, the guidance device may be embodied to transfer only a single filter tow strip to a downstream-positioned single-rod forming module. Alternatively, the guidance device may be embodied to combine at least two filter tow strips and guide these jointly to a downstream-positioned continuous rod-forming machine for producing filters that consist of at least two filter tow strips. This latter embodiment is suitable for processing at least two filter tow strips that consist of different materials and/or have different characteristics, thereby resulting in filters for which the smoking gas paths can be controlled, for example as a result of differences in the drag resistances of the individual types of tow.

Of course, each processing unit can also be connected to a separate single-rod forming module, which must then be embodied as a single-rod forming machine.

It is also possible to embody each processing unit such that it can be connected to one continuous-rod forming line of a downstream-positioned multi-rod forming machine.

The processing units may be arranged in different ways, relative to the movement direction of the processed filter tow strips when these exit from the apparatus. For example, it is conceivable that the processing units are arranged one behind the other and/or essentially side-by-side.

The same is also true for the filter tow supply, relative to the movement direction of the processed filter tow strips when these exit from the apparatus. In particular, the filter tow supply can be arranged essentially adjacent to (i.e. laterally beside) and/or in front of the processing units. It is also conceivable to combine the filter tow supply into groups, for example by essentially arranging the filter tow supply side-by-side inside a group and positioning the group essentially in front of the processing units.

Configuring the apparatus in this way permits the optional setup of the machines either in a row or at an angle. In the latter case, the processing units are essentially arranged in a row that is positioned at an angle, preferably approximately at a right angle, to the processing direction for a downstream-positioned apparatus.

Within the framework of a multi-rod filter production, the invention provides the option of coupling a multi-rod processing apparatus, composed of a group of modular processing units, with single-rod, dual-rod, and/or multi-rod filter makers. The special feature of this modular coupling in particular is that the continuous filter rods can be produced independently in one and the same system and that different adjustments can be made independent of each other. Also provided is the option of having extremely high format flexibility, including the production of filters of different length. It is advantageous if the multiple filter tow rods are threaded continuously into the system. The filters may thus be produced based on demand, with the processing units respectively supplying the processed filter tow in the required form. A modular design of the apparatus in particular has the advantage of making possible a quick realization of individual multi-rod systems and of allowing the output to maintain a higher capacity because the production on the remaining rod-forming lines can continue if an interruption occurs in the operation of one rod-forming line.

BRIEF DESCRIPTION OF THE DRAWINGS

These and other features and advantages of the invention will be further understood from the following detailed description with reference to the accompanying drawings, which show in.

DETAILED DESCRIPTION

Figure 1:
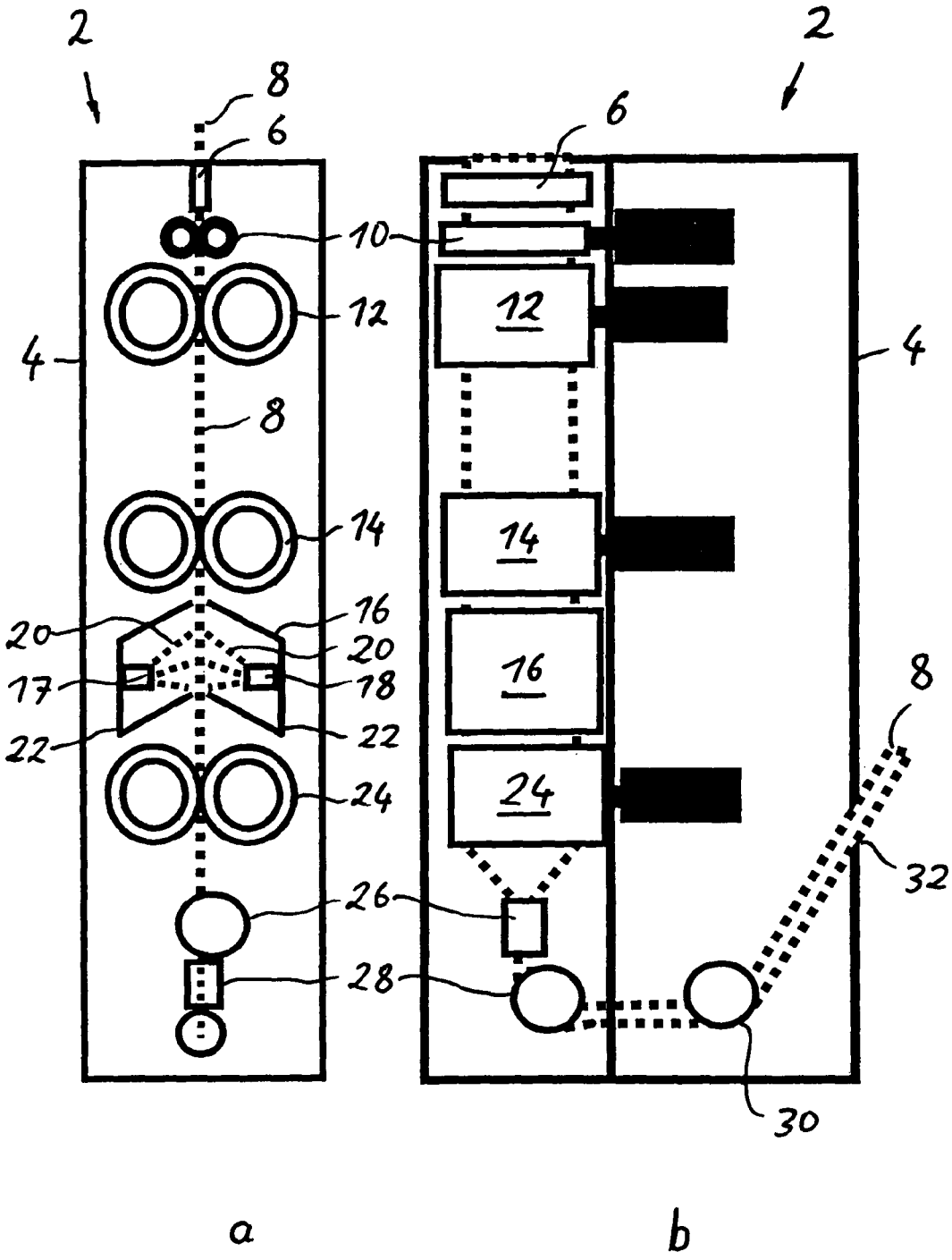
FIG. 1*a*: A schematic cross section and in FIG. 1*b* a longitudinal section through a processing module according to one embodiment of the invention.

The Figures contain schematic and in part detailed views of the processing modules and the apparatus employing principles of the invention, which comprises these modules, for processing filter tow strips for rod-shaped articles of smoking such as cigarettes, using the continuous rod-forming method. The Figures essentially show only the parts and components that are necessary for understanding the invention. For ease of illustration, machine components generally used in the field of mechanical engineering, for example details of the machine frame, holders, bearings, and claddings, are not shown in further detail in the drawings.

Referring to the drawings, there is schematically shown in FIG. 1*a* a cross section and in FIG. 1*b* a longitudinal section of a processing module 2 comprising a housing 4. Housing 4 has an inlet 6 at its top through which a filter tow strip 8 enters into the housing. Prior to entering the housing 4, the filter tow strip 8 is pulled from a filter tow bale (not shown in FIGS. 1*a* or 1*b*) and is redirected in the direction of the inlet 6 with the aid of a deflection and tow-spreading member (not shown in the Figures), arranged at the upper end of a supporting arm (also not shown in the Figures).

The embodiment of FIGS. 1*a* and 1*b* shows the filter tow strip 8 entering through the inlet 6 and passing through the processing module 2 along a downward directed, vertical segment of a tow guidance section that is not shown in further detail herein. The downward movement of the filter tow strip 8 is supported by the effect of gravity. The filter tow strip 8 has a flat shape when entering through the inlet 6 as reflected by FIG. 1*b*.

The threading of the filter tow strip 8 into inlet 6 also occurs under the effect of gravity. To support the threading operation, the processing module 2 for the illustrated embodiment includes a pair of threading rollers 10 that are arranged directly below inlet 6. After passing through the threading roller pair 10, the filter tow strip 8 moves through different processing devices.

Following roller pair 10, the filter tow strip 8 then passes through a known drawing device consisting of a roller pair 12 and an additional downstream-positioned roller pair 14, wherein these are used for the primary drawing of the filter tow strip 8.

Downstream of the lower roller pair 14, the filter tow strip 8 moves through a treatment device 16, which is provided with two spaced-apart spray nozzles 17, 18, between which the filter tow strip 8 moves through at a distance. In this way, the filter tow strip 8 is sprayed inside the treatment device 16 on both sides with a treatment fluid 20, as illustrated with the spray nozzles 17, 18 in FIG. 1*a*. The vertical movement of the filter tow strip 8 inside of the treatment device 16 prevents any contact with the spray nozzles 17, 18 that are arranged on both sides. Even a possible forming of drops is not critical and does not affect the filter tow strip 8. This is particularly important in case of a possible interruption in the operation or a machine stoppage. In that case, the treatment fluid 20 drips vertically downward from the spray nozzles 17, 18, at a distance to the filter tow strip 8, and is collected inside a cup-shaped bottom section 22 of the treatment device 16.

Following the exit from the treatment device 16, the filter tow strip 8 passes through a different roller pair 24 before being reshaped into a round form inside a forming device 26 that is arranged underneath. For the embodiment shown in FIGS. 1*a* and 1*b*, the round-formed filter tow strip is subsequently redirected by a deflection roller 28, positioned below the forming device 26, to a horizontal segment of the tow guidance section and an additional deflection roller 30. This horizontal segment of the tow guidance section may extend in the plane that is defined by the flat filter tow strip 8 in the area of the tow guidance section that is located between the inlet 6 and the forming device 26, or parallel to this plane, and thus in the drawing plane of FIG. 1*b*. The round filter tow strip 8 shown in the embodiment according to FIGS. 1*a* and 1*b* is then deflected by the additional deflection roller 30 to move in a slanted upward direction toward an outlet 32 in the housing 4, through which the filter tow strip 8 is discharged from the processing module 2. Alternatively, it is also conceivable that the round filter tow strip exiting the forming device 26 is deflected in a different direction, for example transverse to the plane that is defined by the flat filter tow strip 8 between the inlet 6 and the forming device 26.

As can be seen in FIGS. 1*a* and 1*b*, the processing devices are positioned one below the other because of the vertical tow movement. Accordingly, the housing 4 can be opened for easy access to these processing devices, for example for the purpose of performing maintenance. The processing module shown in FIGS. 1*a* and 1*b* may be used as an individual functional unit with a downstream-positioned continuous rod-forming machine. However, since the configuration is based on a modular concept with essentially uniform interfaces and the use of as many identical parts as possible, this processing module can be easily used without considerable structural expenditure together with several identical processing modules, in combination with a downstream-positioned multi-rod forming machine for multi-rod filter production. Examples of such combinations are shown in FIGS. 2 to 8, wherein the examples shown therein are not exhaustive.

Figure 2:
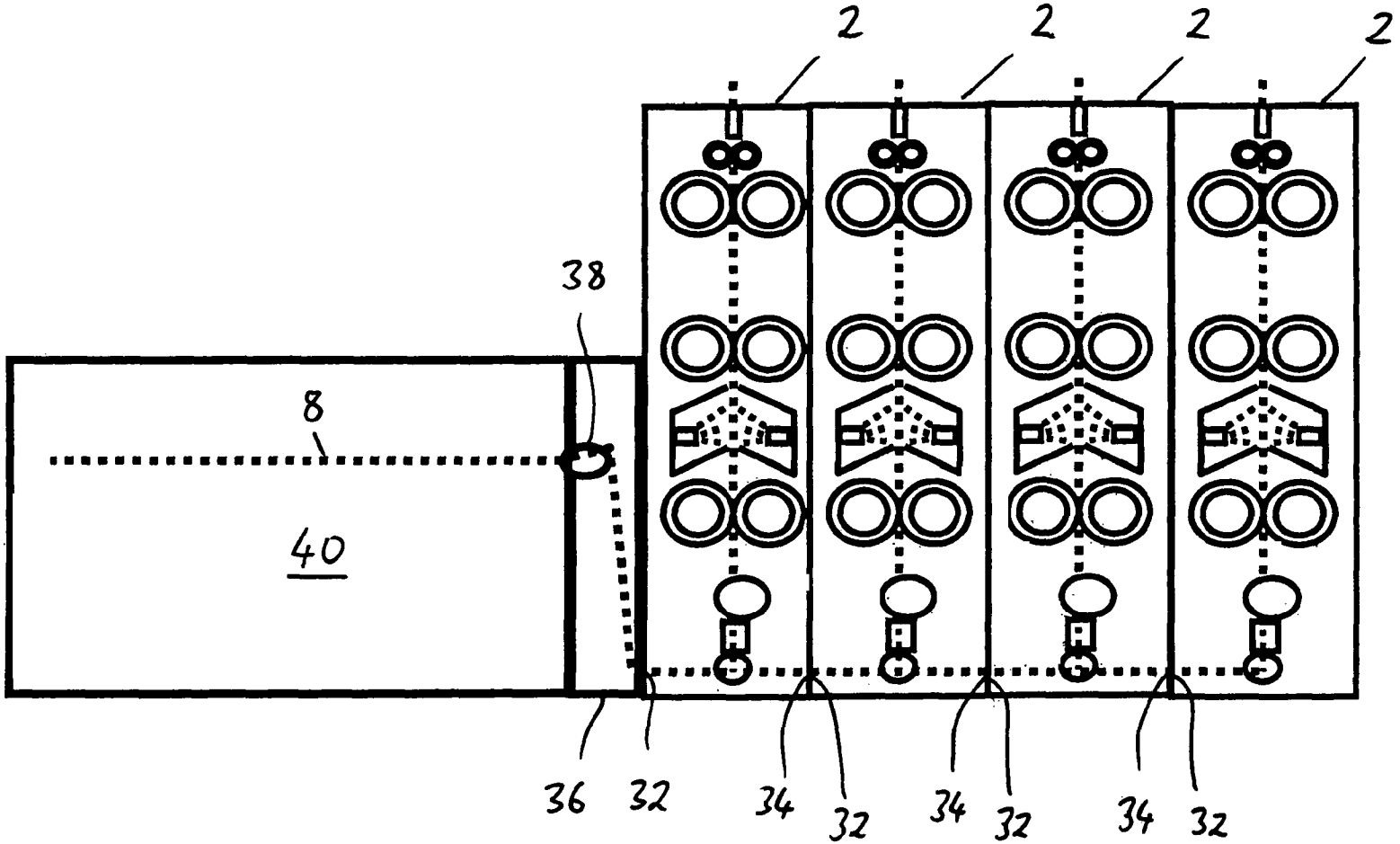
FIG. 2: A schematic cross section through a combination of four processing modules, arranged one behind the other, with a four rod-forming machine.

FIG. 2 shows a longitudinal section through a combination apparatus of four processing modules 2, arranged one behind the other, with a downstream-positioned continuous rod-forming machine for the production of four filter rods. In this example, the four processing modules 2 are arranged one behind the other in the production direction and the filter tow strips 8, which are processed and shaped to be round by these modules, also exit in the same direction. In contrast to the illustration in FIG. 1*b*, this direction is transverse to the plane defined by the flat filter tow strip between the inlet and the forming device. Thus, each processing module 2 must be provided with at least one additional inlet 34, through which the filter tow strip 8 of the respectively adjacent processing module 2 enters, wherein the strip exits through an additional outlet 32 provided in each module. In this way, it is ensured that the filter tow strips 8 pass sequentially through the processing modules 2. It is important here that the inlets 34 and the outlets 32 are aligned with each other to form uniform interfaces. If necessary, additional outlets can also be provided to take into consideration the offset apparatus of the filter tow strips 8. Accordingly, a corresponding number of inlets 34 must be provided, or these must also be arranged offset. Alternatively, it is also conceivable to provide the inlets 34 and the outlets 32 in the form of elongated openings, which jointly accommodate the filter tow strips 8. The latter option is preferred in view of a consequent modularity.

In this connection and for the sake of completeness, the outlets 32 for the processing modules 2 shown in FIG. 2 are arranged lower than those in FIGS. 1*a*, 1*b*, wherein they are positioned just above the bottom of the housing for the processing modules 2. The height of the outlets 32 may thus be selected optionally, provided the interfaces for all processing modules 2 are the same, and are also adapted correspondingly in view of the further transport to the downstream-positioned continuous rod-forming machine.

For the apparatus shown in FIG. 2, an additional transition module 36 is provided in which the four filter tow strips 8, which for reasons of simplicity are shown only as a joint dashed line in FIG. 2, are continued and combined so that they may enter a downstream-positioned multi-rod forming machine 40. The embodiment illustrated in FIG. 2 shows that the filter tow strips 8 are redirected to a higher level, relative to the outlet 32, wherein FIG. 2 shows only the upper deflection roller 38 intended for this.

Figure 3:
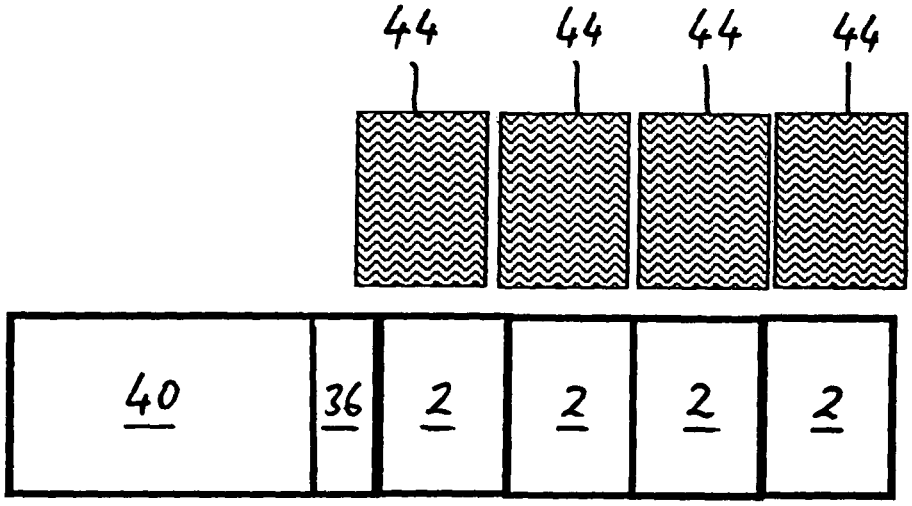
FIG. 3: A schematic view from above of the apparatus according to FIG. 2.

The same four-rod apparatus is shown schematically in FIG. 3, in a view from above. Furthermore visible are four tow bales 44, wherein each tow ball 44 is assigned to one processing module 2. For the apparatus according to FIG. 3, each tow bale 44 is placed beside the associated processing module 2, thus making it possible to realize the same distance, relative to each processing module, for pulling the respective filter tow strip from the associated tow bale 44. When pulling the filter tow strip from the tow bale 44, it is important to ensure that the filter tow strip is deflected by approximately 90°, so that it enters the processing module 2 while oriented transverse to the processing direction.

Figure 4:
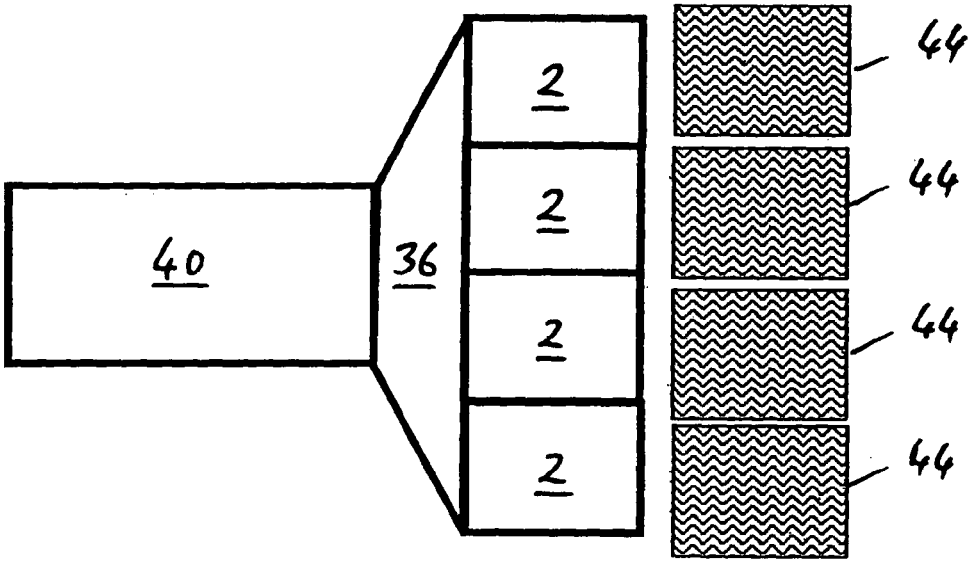
FIG. 4: A schematic view from above of a combination of four processing modules, arranged side-by-side, with a four rod-forming machine.

FIG. 4 also shows an apparatus for producing four continuous rods. However, this apparatus differs from the apparatus shown in FIGS. 2 and 3 in that the four processing modules 2 are not arranged one behind the other, but side-by-side, so that the filter tow strips must be correspondingly combined at an angle in the transition module 36, before they are transferred to the multi-rod forming machine 40. The relative assignment of the tow bales 44 to the processing modules 2 corresponds to the assignment shown in FIG. 3. According to FIG. 4, the tow bales 44 are therefore respectively positioned in front of the processing modules 2, as seen in processing direction.

The advantage of the apparatus according to FIG. 4 is that the filter tow strip does not need to be deflected after it is pulled from the tow bale 44 and before it enters the processing module 2.

Figure 5:
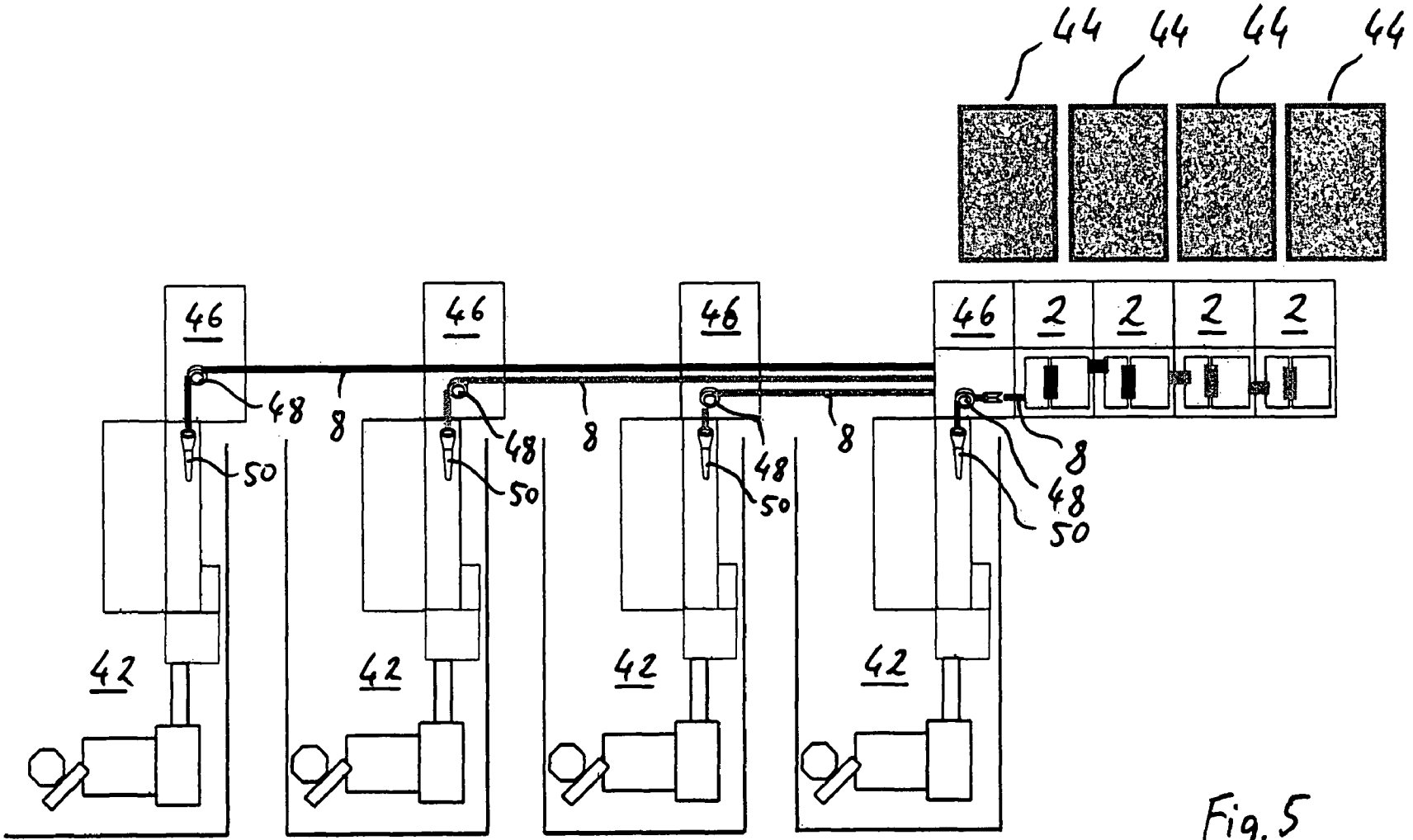
FIG. 5: A schematic view from above of a combination of four processing modules, arranged side-by-side as shown in FIG. 3, with four single-rod forming modules, which may be provided either as a single machine for forming four rods, as shown in FIGS. 2 and 3, or alternatively as separate single-rod forming machines.

FIG. 5 contains a similar apparatus as shown in FIGS. 2 and 3, but with the difference that four individual, downstream-positioned single-rod forming modules 42 are shown. A separate processing module 2 is assigned to each single-rod forming module 42, so that respectively one filter tow strip 8 which is processed by a processing module 2 is subjected to further processing in a single-rod forming module 42. To be sure, the four filter tow strips 8 exiting the processing modules 2 are guided parallel, in the same way as for the apparatus according to FIG. 2. However, the apparatus shown in FIG. 5 differs from the apparatus in FIG. 2 in that the filter tow strips 8 are redirected by approximately 90° before entering the downstream-positioned single-rod forming modules 42. For this, four separately arranged guide modules 46 are provided (in place of the single transition module 36 shown in FIGS. 2 and 3), which are respectively provided with a deflection roller 48 for deflecting the associated filter tow strip 8.

The filter tow strips 8 enter the single-rod forming modules 42 through an intake finger 50, which is a component of each of the single-rod forming modules 42. FIG. 5 otherwise contains additional components of the single-rod forming module 42, which are not individually provided with reference numbers.

In the same way as for the apparatuses shown in FIGS. 2 to 4, the processing modules 2 in FIG. 5 are combined into a group and jointly form a processing apparatus, in this case for producing four continuous rods.

The four single-rod forming modules 42, shown in FIG. 5, may take the form of a single machine producing four continuous rods, similarly as shown in FIGS. 2 to 4 with the schematically represented multi-rod forming machine 40, or alternatively can also be embodied as four separate single-rod forming machines.

The guide modules 46 may be provided as separate modules or, alternatively, as components of the respective single-rod forming module 42.

Figure 6:
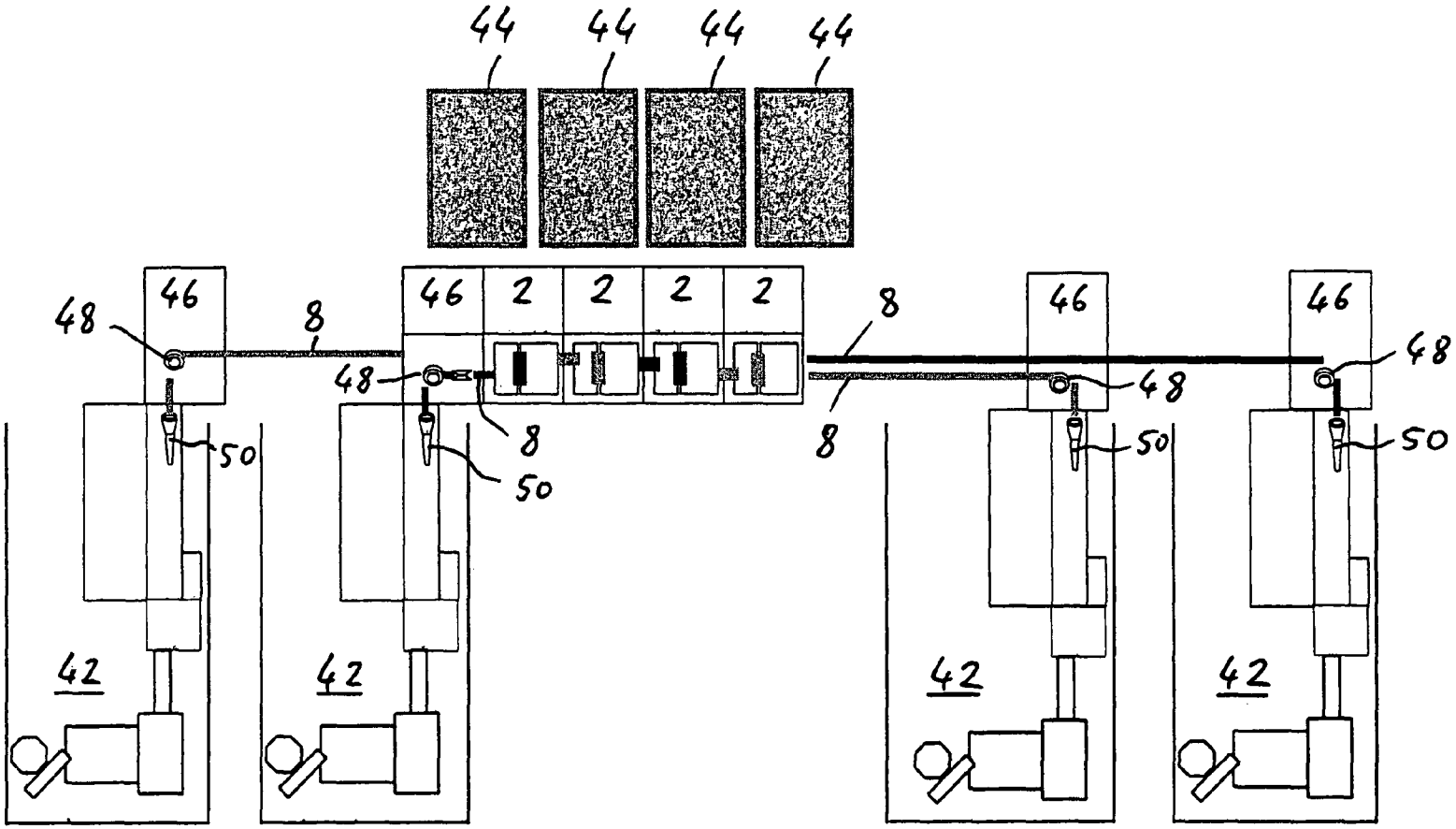
FIG. 6: A schematic view from above of a combination of four processing modules, arranged side-by-side as shown in FIG. 3, with four single-rod forming modules, which differ from the apparatus according to FIG. 5 in that two single-rod forming modules are respectively arranged on each side of the group of four processing modules and that these may be provided either jointly as dual-rod forming modules or alternatively as separate single-rod forming modules.

FIG. 6 shows a similar apparatus as shown in FIG. 5, but with the difference that the four single-rod forming modules 42 are paired into two groups and that the four processing modules 2 are arranged between these two groups. For the apparatus according to FIG. 6, two adjacent single-rod forming modules 42 are arranged on one side, while the other two single-rod forming modules 42 are arranged adjacent to each other on the other side of the group consisting of four processing modules 2. As a result, the filter tow strips 8 that are processed by the processing modules 2 do not exit in the same direction from the group comprising the processing modules 2, as shown in FIG. 5. Instead, two filter tow strips 8 are guided in one direction and the other two filter tow strips 8 in the opposite direction. In the process, the two filter tow strips 8 that are guided toward one group of single-rod forming modules 42 are discharged from the processing modules 2 which are closest to the respective group of two single-rod forming modules 42. According to FIG. 6, the two left processing modules 2 therefore serve the two left single-rod forming modules 42 and the two right processing modules 2 serve the two right single-rod forming modules 42.

Whereas with the apparatus according to FIG. 6, the four processing modules 2 form a joint processing apparatus, in the same way as shown in FIG. 5, the single-rod forming modules 42 optionally can be provided as separate single-rod forming machines or can be paired into groups comprising single-rod forming modules 42, so as to form respectively one joint dual-rod forming machine.

Figure 7:
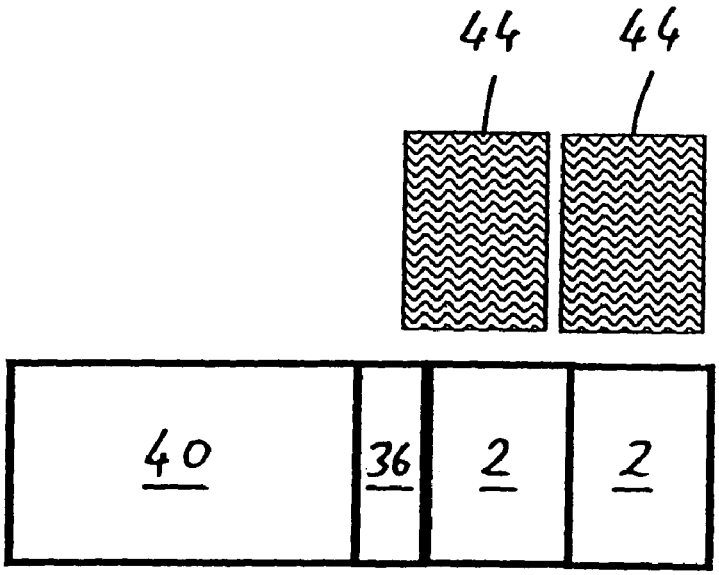
FIG. 7: A schematic view from above of a combination of two processing modules, arranged one behind the other, with a multi-rod forming machine, wherein each processing module is assigned a tow bale that is positioned next to it.

A similar apparatus as shown in FIG. 3 is also shown in FIG. 7, with the difference that only two processing modules 2 are used for a dual-rod filter production. In a similar manner, this also applies to FIG. 8 as compared to FIGS. 3 and 4.

Figure 9:
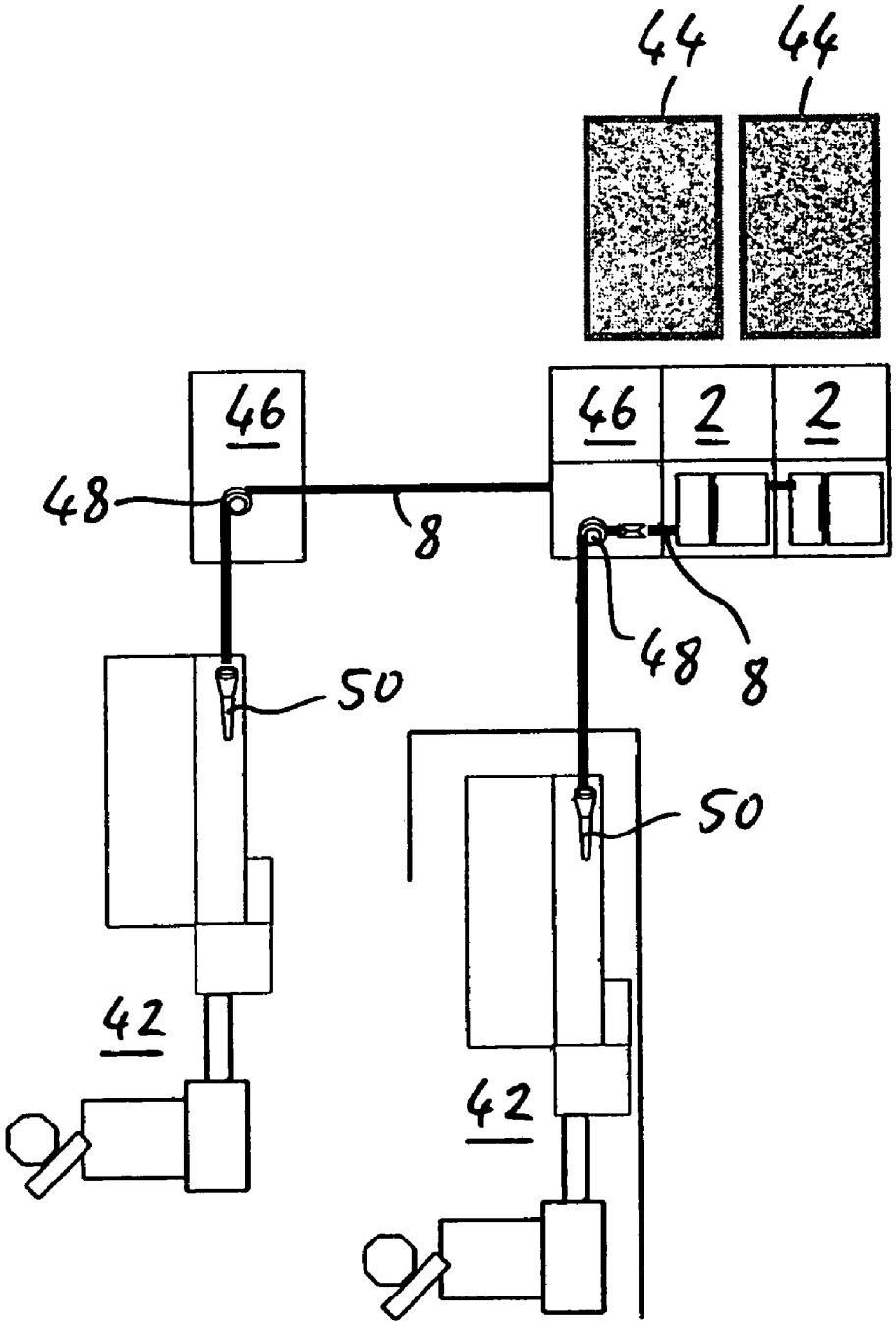
FIG. 9: A schematic view from above of a combination of two processing modules, arranged one behind the other, with two single-rod forming modules, which may be embodied as joint dual-rod forming machine or alternatively as separate single-rod forming machines.

FIG. 9 contains a similar apparatus as shown in FIG. 5, but again with the difference that only two processing modules 2 are used for the dual-rod filter production. FIG. 9 insofar shows an apparatus that corresponds to the left half of the apparatus shown in FIG. 6.

Figure 10:
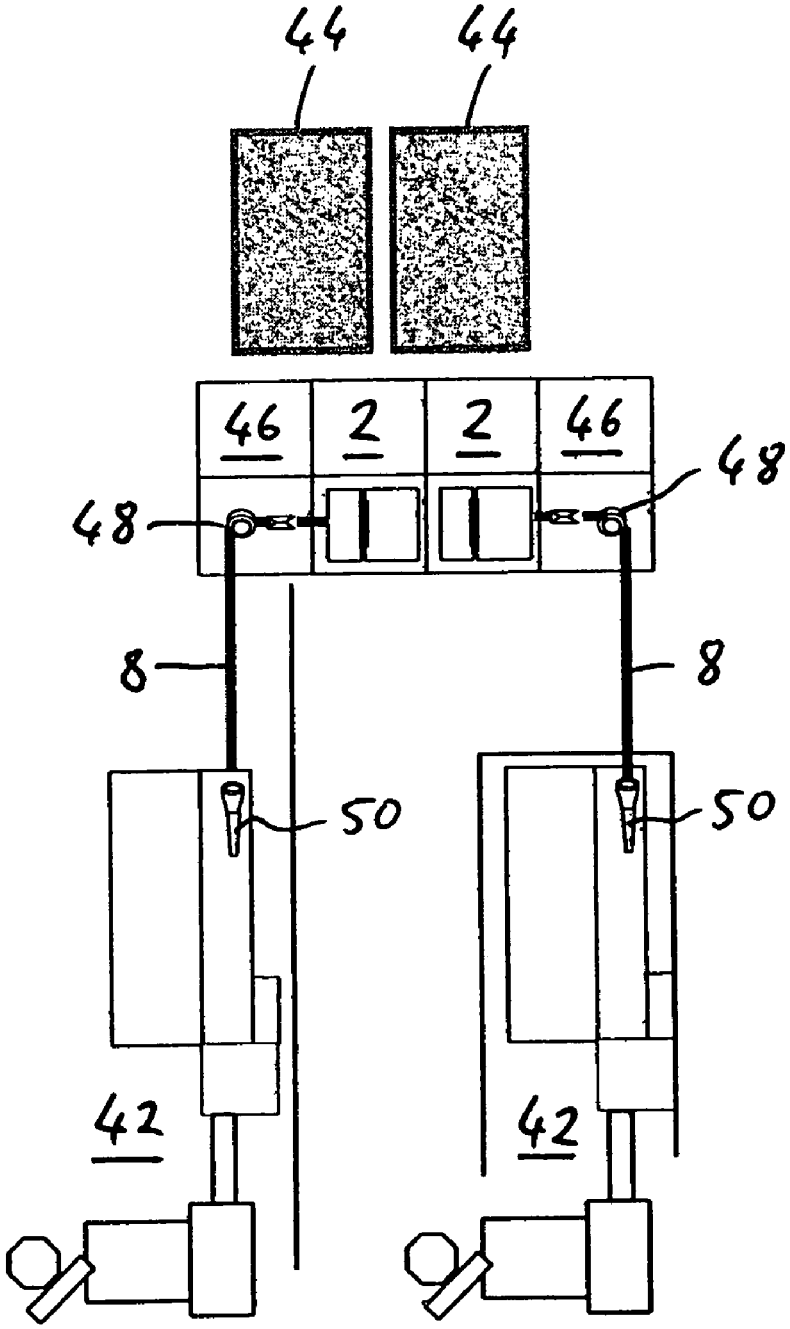
FIG. 10: A schematic view from above of a combination of two processing modules, arranged one behind the other, with two single-rod forming modules, of which, respectively, one is arranged on one side and the other on the other side of the group consisting of two processing modules.

FIG. 10 shows a similar apparatus as the one in FIG. 6, but with the difference that only two processing modules 2 are used for a dual-rod filter production, with respectively only a single-rod forming module 42 positioned on each side. For the apparatus according to FIG. 10, the two single-rod forming modules 42 must therefore be provided as separate single-rod forming machines.

Figure 8:
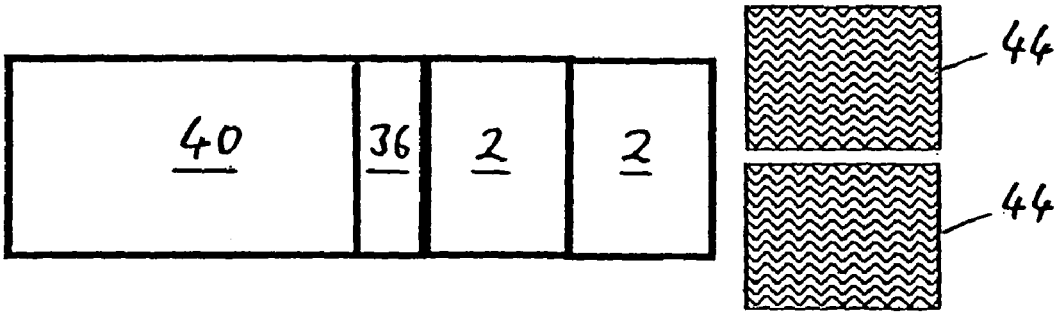
FIG. 8: A schematic view from above of a combination of two processing modules, arranged one behind the other, with a multi-rod forming machine, wherein each processing module is assigned a tow bale and wherein the two tow bales are positioned side-by-side in front of the respective processing module.
Figure 11:
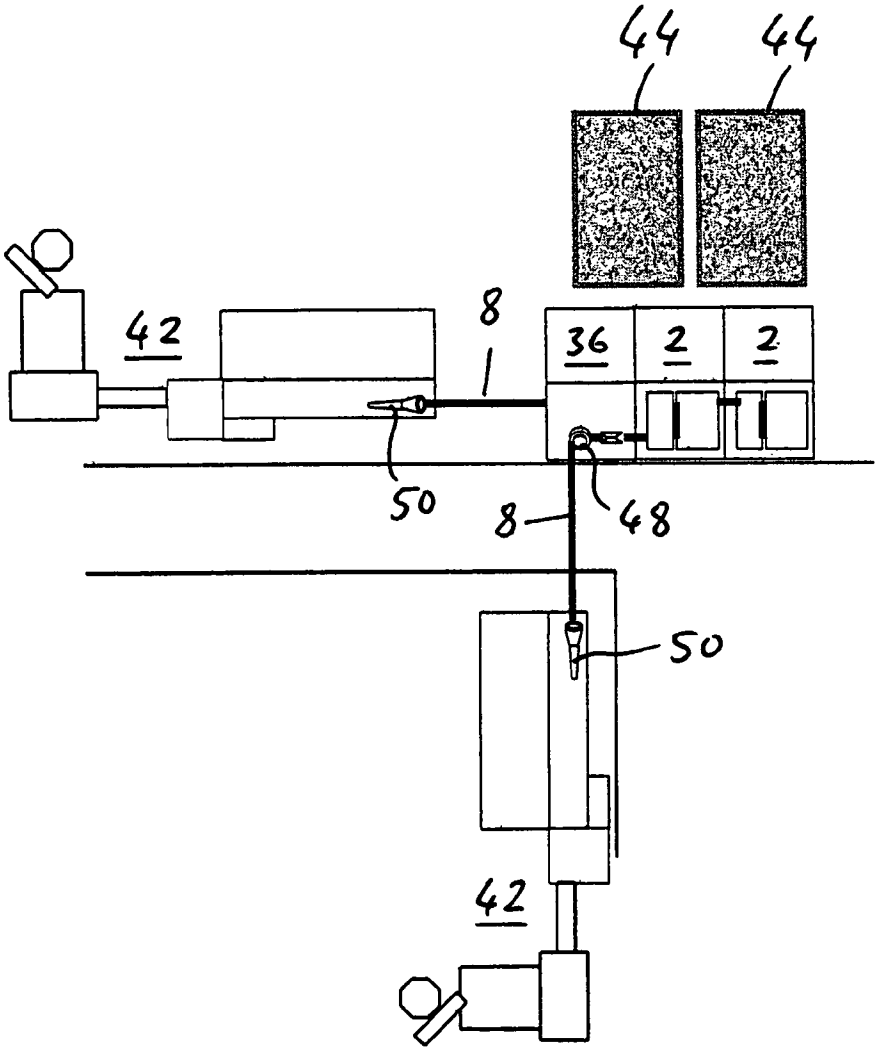
FIG. 11: A schematic view from above of a combination of two processing modules, arranged one behind the other, with two separately erected single-rod forming modules, which are respectively provided as separate single-rod forming machines.

FIG. 11 shows an apparatus that differs from the apparatus in FIG. 9 in that the two single-rod forming modules 42 are not arranged parallel to each other. Instead, one of the two single-rod forming modules 42 (the 'upper' single-rod forming module 42 according to FIG. 11) is oriented in the direction in which the filter tow strip 8 exits from the associated processing module 2, relative to its processing direction, which corresponds to the direction of the rod-forming line. In contrast to the other single-rod forming module 42, no redirecting of the filter tow strip 8 is consequently required. Thus, a joint transition module 36 of the type as shown in FIGS. 7 and 8 is used for this apparatus, in which only the one filter tow strip 8 (according to FIG. 11 the 'lower' one) is deflected via a deflection roller 48. As a result, the two single-rod forming modules 42 used in the apparatus according to FIG. 11 are provided as separate single-rod forming machines.

Figure 12:
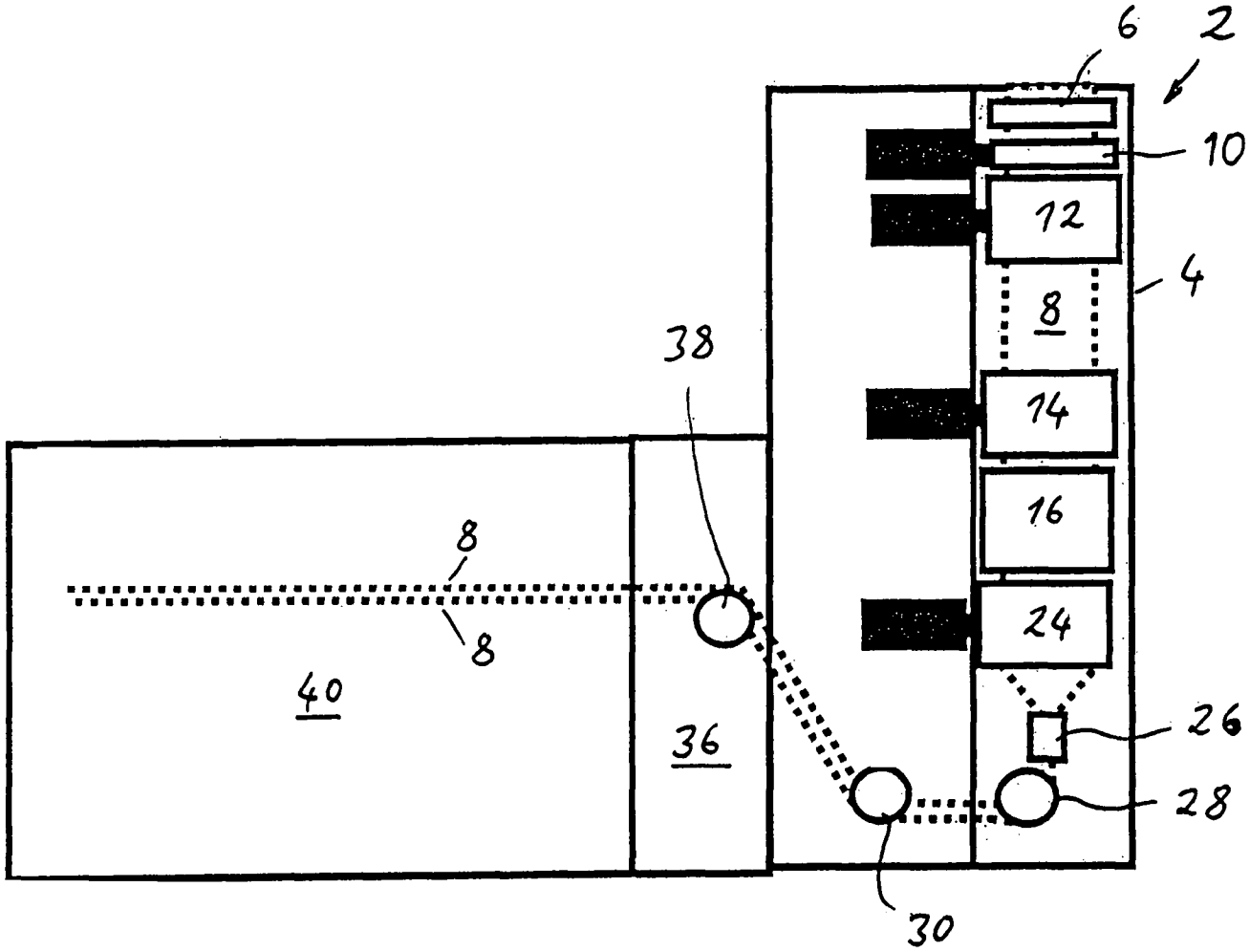
FIG. 12: A schematic longitudinal section through a combination, consisting of a visible first single-rod processing module and a non-visible additional single-rod processing module that is arranged behind, as well as a multi-rod forming machine.

FIG. 12 shows a different embodiment, for which the multi-rod forming machine 40 is arranged to be offset by 90° as compared to FIG. 2, in that the filter tow strip 8 that is guided through the processing modules 2 is positioned in a plane that is parallel to the processing direction of a downstream-positioned multi-rod forming machine 40. For this apparatus, the filter tow strip 8 must be deflected to the side when it exits from the forming device, as shown schematically in FIG. 12. This apparatus consequently uses the same processing modules 2 as shown in FIG. 1*b*. In order to simplify the representation, FIG. 12 shows only the processing module 2 in front, which faces the observer, while the additional processing modules 2 that are arranged behind are not visible. The apparatus of the processing modules 2, shown in FIG. 12, corresponds to the apparatus shown in FIG. 4, wherein the filter tow strips 8 that are pulled from the tow bales 44 must be deflected by 90° before entering the processing modules 2. FIG. 12 schematically shows that the processing modules 2 can also be positioned optionally in an apparatus that is offset by 90° as compared to FIG. 2.

The processing modules 2 described with the aid of FIGS. 1 to 12 have only a single tow guidance section and are therefore embodied as single-rod forming modules. In principle, it is also conceivable to process more than one filter tow strip with a single processing module 2.

Figure 13:
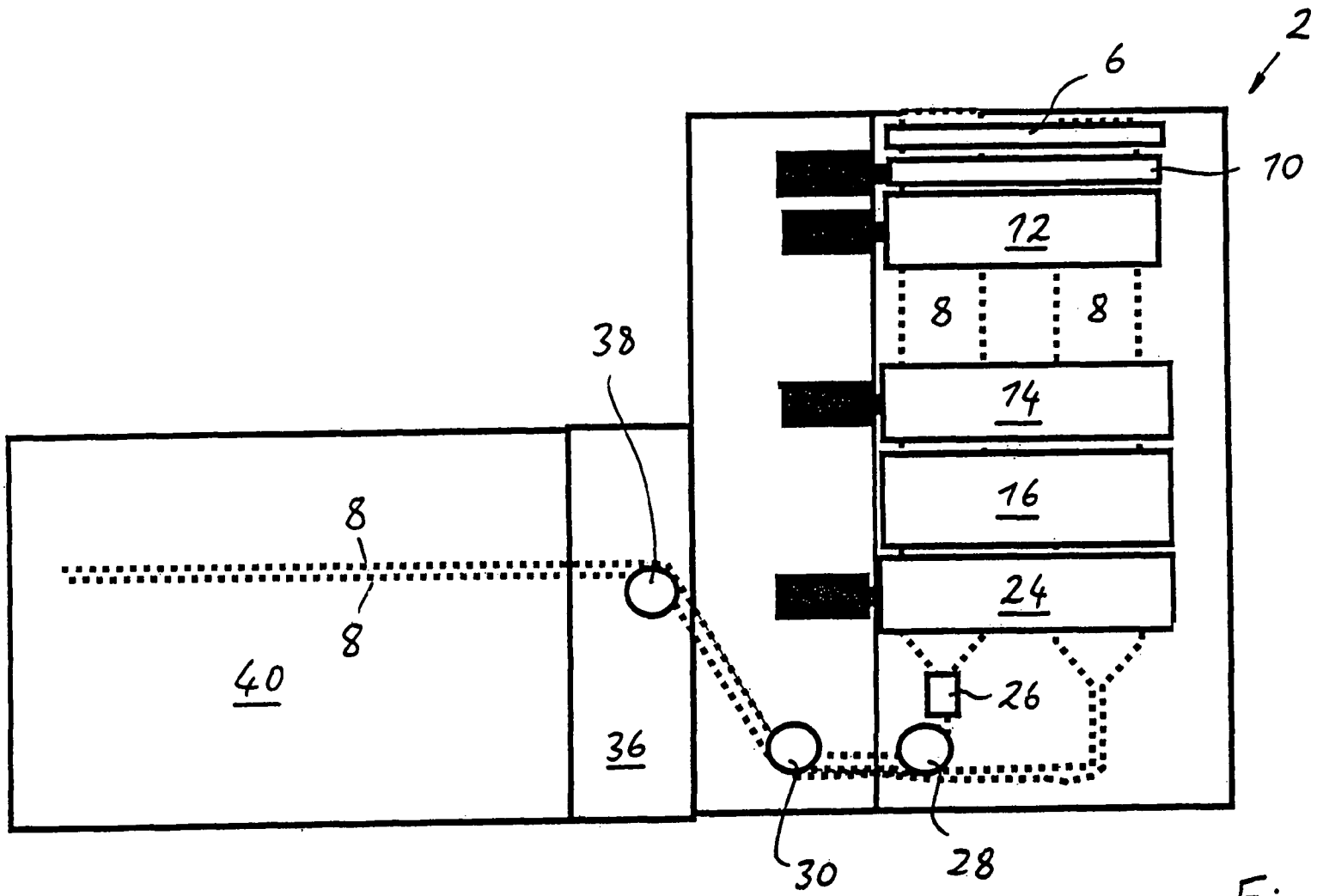
FIG. 13: A schematic longitudinal section through a combination of a visible dual-rod forming module according to a different embodiment with a multi-rod forming machine.

The example in FIG. 13 shows a processing module 2, which can be used to process two filter tow strips 8 that are essentially positioned side-by-side in the same plane before being jointly deflected to the side, in the direction of the transition module 36. The example in FIG. 13 furthermore schematically shows that each of the processing devices is embodied such that it can be used to simultaneously process both filter strips 8. The roller pairs in this case must be embodied such that two filter tow strips 8 can jointly pass through. The same is true for the treatment device, whereas a separate forming device must be provided for each filter tow strip 8.

At least one dual-rod filter can be produced with the apparatus shown in FIG. 13. With the use of several processing modules 2 of this type, which are arranged in a row and at a right angle to the viewing plane in FIG. 13, a filter can be produced that consists of a number of rods, amounting to a multiple of two.

The processing modules 2 described with the aid of FIGS. 1 to 13 respectively only process a single continuous rod in a downstream-positioned multi-rod forming machine 40 and/or a downstream-positioned and correspondingly assigned single-rod forming module 42. However, it is conceivable in principle to use at least two filter tow strips 8, which are respectively supplied by different processing modules 2, for producing one and the same filter.

Figure 14:
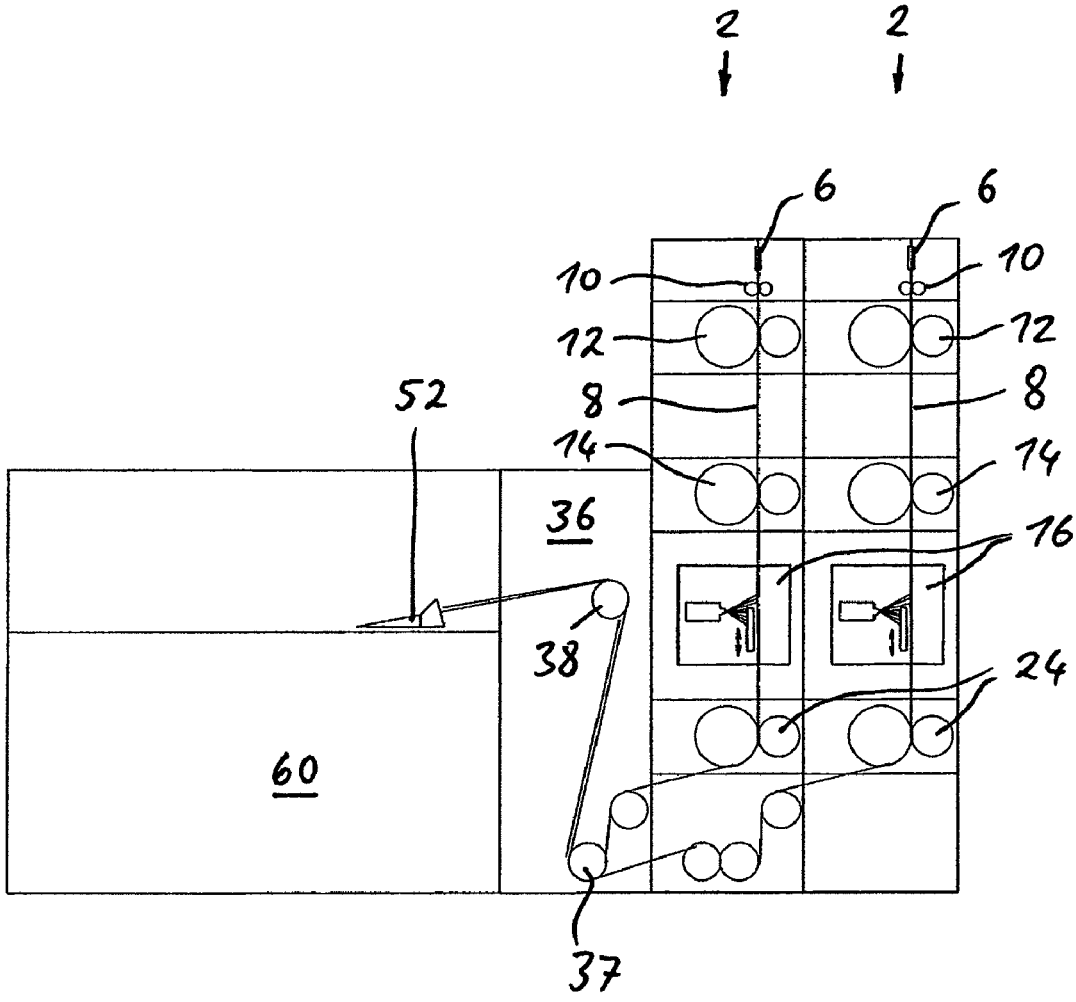
FIG. 14: A schematic cross section through a combination consisting of two processing modules, arranged one behind the other, with a single-rod forming machine, in which the filter tow strips processed in both processing modules are used jointly for producing a filter.

FIG. 14 shows an example of an apparatus with two processing modules 2, positioned one behind the other, wherein the filter tow strips 8 processed by these modules are combined with the aid of deflection rollers 37, 38 in a downstream-installed, joint transition module 36. A downstream-positioned continuous rod-forming machine 60 is provided on the inlet side with a combination inlet finger 52, in which the two filter tow strips 8 that are combined in the transfer module 36 are joined, such that they can be processed jointly in the rod-forming machine 60 to form a single continuous rod for producing a filter.

For the sake of completeness, it is noted that the tow bales 44 are not shown in FIGS. 12 to 14, in the same way as they are not shown in FIGS. 1 and 2.

In principle, it is also possible to combine the single-rod processing modules according to FIGS. 1 to 12 and 14 with the dual-rod or multi-rod processing modules according to FIG. 13.

It will be understood that the above description of the present invention is susceptible to various modifications, changes and adaptations, and the same are intended to be comprehended within the meaning and range of equivalents of the appended claims.

What is claimed is:

1. A processing unit for processing at least one continuous filter tow strip to produce filters for rod-shaped smoking articles, comprising:

at least one tow guidance section along which the continuous filter tow strip is moved in a direction of a longitudinal extension of the continuous filter tow strip, the tow guidance section including processing devices used for processing the continuous filter tow strip, wherein the processing devices comprise devices for spreading, drawing, treating and/or forming of the continuous filter tow strip, wherein the processing devices are arranged in a sequence essentially one above the other, so that the continuous filter tow strip is subjected to a downward movement at least in a segment of the tow guidance section which is located in the region of the processing devices, and wherein the segment of the tow guidance section that is located in a region of the processing devices is oriented at a downward angle to a horizontal line.

2. The processing unit according to claim 1, wherein the angle is approximately perpendicular to the horizontal line.

3. The processing unit according to claim 1, wherein the processing unit comprises a module with a defined interface to connect the processing unit to at least one additional processing unit.

4. The processing unit according to claim 1, wherein the processing unit includes an interface to connect the processing unit to a downstream-positioned apparatus to further process the continuous filter tow strip.

5. The processing unit according to claim 1, wherein the continuous filter tow strip is moved at least partially by the force of gravity at least in the segment of the tow guidance section that extends in the region of the processing devices.

6. The processing unit according to claim 5, wherein the inlet is arranged above the highest located processing device.

7. The processing unit according to claim 1, including an inlet that forms a start of the tow guidance section, wherein the inlet is not positioned lower than the highest-positioned processing unit.

8. The processing unit according to claim 7, further comprising an outlet through which the processed continuous filter tow strip exits in a direction of a down-stream-positioned device for further processing, wherein the processing unit is adapted to receive the continuous filter tow strip at the inlet from a filter tow supply approximately in the direction in which the processed continuous filter tow strip exits from the outlet.

9. The processing unit according to claim 7, further comprising an outlet through which the processed continuous filter tow strip exits in a direction of a down-stream-positioned device for further processing, wherein the processing unit is adapted to receive the continuous filter tow strip from a filter tow supply to the inlet at an angle approximately transverse to the direction in which the processed continuous filter tow strip exits from the outlet.

10. The processing unit according to claim 7, further including a pair of threading rollers arranged downstream of and adjacent to the inlet.

11. The processing unit according to claim 1, wherein said unit includes an outlet where the processed continuous filter tow strip exits in a direction of a downstream-positioned device for the further processing, and the tow guidance section extends at least in part approximately horizontal between the last processing device and the outlet.

12. The processing unit according to claim 1, further comprising an outlet through which the processed continuous filter tow strip exits in a direction of a down-stream-positioned device for further processing, wherein the tow guidance section extends at least in part approximately horizontal between a processing device that is positioned at the lowest point and the outlet.

13. The processing unit according to claim 1, wherein the last processing device in the sequence comprises a device for the round-forming of the continuous filter tow strip.

14. The processing unit according to claim 1, wherein one of the processing devices comprises a device for treating the continuous filter tow strip by spraying a treatment fluid onto the continuous filter tow strip in a direction approximately transverse to the movement direction of the continuous filter tow strip.

15. The processing unit according to claim 14, wherein said one device is adapted to spray the treatment fluid onto both sides of the continuous filter tow strip.

16. The processing unit according to claim 1, wherein one of the processing devices is adapted to inject carbon into the continuous filter tow strip.

17. The processing unit according to claim 1, including an inlet to receive continuous filter tow strip from a continuous filter tow strip supply and forming a start of the tow guidance section; an outlet through which the processed continuous filter tow strip exits in a direction of a down-stream-positioned device for further processing; and an additional inlet and an additional outlet to guide through at least one additional continuous filter tow strip that is processed by a different processing unit.

18. The processing unit according to claim 1, wherein the at least one tow guidance section includes at least two guidance sections for the tow.

19. The processing unit according to claim 18, wherein the at least two guidance sections extend parallel to each other.

20. The processing unit according to claim 18, wherein at least some of the processing devices are jointly assigned to the at least two tow guidance sections.

21. An apparatus for processing filter tow material for producing filters for rod-shaped smoking articles, comprising:

at least two processing units according to claim 1; and filter tow supplies each supplying a continuous filter tow strip to a respective one of the processing units.

22. The apparatus according to claim 21, further including at least one downstream-positioned device and a guiding device to transfer the continuous filter tow strips that are processed by the processing units to the at least one downstream-positioned device for further processing.

23. The apparatus according to claim 22, wherein the at least one downstream-positioned device comprises a single-rod forming module, and the guiding device is adapted to transfer respectively only one continuous filter tow strip to the single-rod forming module.

24. The apparatus according to claim 22, wherein the at least one downstream-positioned device comprises a continuous rod-forming machine for producing filters composed of at least two continuous filter tow strips, and the guiding device is adapted to combine at least two continuous filter tow strips and transfer the at least two filter strips jointly to the continuous rod-forming machine.

25. The apparatus according to claim 21, comprising at least two separate single-rod forming modules, wherein each processing unit is adapted to be connected to a separate single-rod forming module.

26. The apparatus according to claim 21, comprising a downstream-positioned multi-rod forming machine, wherein each processing unit is adapted to be connected to a continuous-rod line on the downstream-positioned multi-rod forming machine.

27. The apparatus according to claim 21, wherein the processing units are essentially arranged one behind the other, relative to a movement direction of the processed continuous filter tow strips exiting from the apparatus.

28. The apparatus according to claim 21, wherein the processing units are arranged essentially side-by-side, relative to a movement direction of the processed continuous filter tow strips exiting from the apparatus.

29. The apparatus according to claim 21, wherein the filter tow supplies are arranged essentially to a lateral side of the processing units, relative to a movement direction of the processed continuous filter tow strips exiting from the apparatus.

30. The apparatus according to claim 21, wherein the filter tow supplies are arranged essentially in front of the processing units, relative to a movement direction of the processed continuous filter tow strips exiting from the apparatus.

31. The apparatus according to claim 30, wherein the filter tow supplies are arranged essentially side-by-side in a group, relative to a movement direction of the processed continuous filter tow strips exiting from the apparatus.

32. The apparatus according to claim 21, wherein the processing units are essentially arranged in a row that extends at an angle to a processing direction of a downstream-positioned apparatus.

33. The apparatus according to claim 21, wherein at least one processing unit is positioned at an angle to a processing direction for a downstream-positioned apparatus, as compared to a movement direction of the continuous filter tow strip exiting from the at least one processing unit.

34. The apparatus according to claim 33, comprising at least one guiding device to transfer at least one continuous filter tow strip that is processed by a processing unit to a downstream-positioned apparatus, wherein the guiding device includes a mechanism to deflect the processed continuous filter tow strip.

35. A system for producing filters for rod-shaped smoking articles from filter tow material, comprising:

at least one apparatus according to claim 21 and at least one downstream-positioned apparatus to further process the continuous filter tow strips.

* * * * *